US011002274B2

(12) United States Patent
Sato et al.

(10) Patent No.: US 11,002,274 B2
(45) Date of Patent: May 11, 2021

(54) SCROLL FLUID MACHINE INCLUDING FIRST AND SECOND SCROLL MEMBERS

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Takahide Ito, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 260 days.

(21) Appl. No.: 16/097,749

(22) PCT Filed: Aug. 14, 2017

(86) PCT No.: PCT/JP2017/029327
§ 371 (c)(1),
(2) Date: Oct. 30, 2018

(87) PCT Pub. No.: WO2018/034274
PCT Pub. Date: Feb. 22, 2018

(65) Prior Publication Data

US 2020/0370556 A1 Nov. 26, 2020

(30) Foreign Application Priority Data

Aug. 19, 2016 (JP) ..... JP2016-161207

(51) Int. Cl.
*F04C 18/02* (2006.01)

(52) U.S. Cl.
CPC ..... *F04C 18/023* (2013.01); *F04C 18/0284* (2013.01)

(58) Field of Classification Search
CPC ..... F04C 18/023; F04C 18/0284; F04C 18/0276; F04C 18/0215; F01C 1/0276
See application file for complete search history.

(56) References Cited

U.S. PATENT DOCUMENTS 4,477,238 A 10/1984 Terauchi
5,496,161 A * 3/1996 Machida ..... F04C 18/0276 418/55.2

(Continued)

FOREIGN PATENT DOCUMENTS

CN 102052302 A 5/2011
EP 2527655 A1 11/2012

(Continued)

OTHER PUBLICATIONS

English Translation of JP 2008133778 by Espacenet Sep. 10, 2020.*

(Continued)

*Primary Examiner* — Deming Wan
(74) *Attorney, Agent, or Firm* — Birch, Stewart, Kolasch & Birch, LLP

(57) ABSTRACT

Provided is a scroll fluid machine which can appropriately set a tip clearance between a tooth base and a tooth crest having an inclined portion and can achieve desired performance. An inclined portion in which a distance between opposing surfaces of an end plate of a fixed scroll and an end plate of an orbiting scroll facing each other gradually decreases from an outer peripheral side toward an inner peripheral side is provided. A tip clearance between a tooth crest of a wall of the orbiting scroll and a tooth base of the end plate of the fixed scroll facing the tooth crest at normal temperature is greater on the inner peripheral side than on the outer peripheral side.

2 Claims, 11 Drawing Sheets

(56) References Cited

U.S. PATENT DOCUMENTS

| | | | | |
|---|---|---|---|---|
| 6,050,792 | A * | 4/2000 | Shaffer | F04C 18/0223 418/15 |
| 6,746,224 | B2 | 6/2004 | Itoh et al. | |
| 8,157,550 | B2 | 4/2012 | Kudo | |
| 2002/0054821 | A1 | 5/2002 | Takeuchi et al. | |
| 2009/0208356 | A1 | 8/2009 | Ginies et al. | |
| 2010/0092318 | A1 * | 4/2010 | Sato | F04C 27/007 418/55.2 |
| 2012/0288394 | A1 | 11/2012 | Murakami et al. | |
| 2012/0315173 | A1 | 12/2012 | Nakamura et al. | |
| 2014/0308146 | A1 | 10/2014 | Hirata et al. | |
| 2017/0370219 | A1 | 12/2017 | Takeuchi et al. | |

FOREIGN PATENT DOCUMENTS

| | | | | |
|---|---|---|---|---|
| EP | 2538083 | A1 | 12/2012 | |
| EP | 2894338 | A1 | 7/2015 | |
| JP | 7-35061 | A | 2/1995 | |
| JP | 11-190287 | A | 7/1999 | |
| JP | 2001-12365 | A | 1/2001 | |
| JP | 2002-70766 | A | 3/2002 | |
| JP | 2006-342776 | A | 12/2006 | |
| JP | 2008133778 | A * | 6/2008 | F04C 18/0276 |
| JP | 2008-163895 | A | 7/2008 | |
| JP | 2009-228476 | A | 10/2009 | |
| JP | 2010-196663 | A | 9/2010 | |
| JP | 2012-36825 | A | 2/2012 | |
| JP | 2014-80940 | A | 5/2014 | |
| JP | 2015-55173 | A | 3/2015 | |
| JP | 2016-102486 | A | 6/2016 | |

OTHER PUBLICATIONS

Extended European Search Report, dated May 13, 2019, for European Application No. 17841496.7.

Extended European Search Report, dated May 31, 2019, for European Application No. 17841476.9.

Written Opinion of the International Searching Authority and international Search Report, dated Oct. 17, 2017, for International Application No. PCT/JP2017/029327, with English translations.

Written Opinion of the International Searching Authority and International Search Report, dated Oct. 24, 2017, for International Application No. PCT/JP2017/029241, with English translations.

Written Opinion of the International Searching Authority and international Search Report, dated Oct. 31, 2017, for International Application No. PCT/JP20171029243, with English translations.

U.S. Office Action for U.S. Appl. No. 16/090,725, dated Aug. 7, 2020.

U.S. Office Action for U.S. Appl. No. 16/093,753, dated Jul. 24, 2020.

* cited by examiner

SCROLL FLUID MACHINE INCLUDING FIRST AND SECOND SCROLL MEMBERS

TECHNICAL FIELD

The present invention relates to a scroll fluid machine.

BACKGROUND ART

A scroll fluid machine in which a fixed scroll member including a spiral-shaped wall provided on an end plate and an orbiting scroll member including a spiral-shaped wall provided on an end plate are engaged with each other and rotated in orbital motion to compress or expand fluid is generally known.

A so-called stepped scroll compressor such as that disclosed in Patent Document 1 is known as the above-mentioned scroll fluid machine. In this stepped scroll compressor, a step is provided at a position along the spiral direction in the tooth crest surfaces and the tooth base surfaces of the spiral-shaped walls of the fixed scroll and the orbiting scroll such that the height of the wall is greater on the outer peripheral side of the step than on the inner peripheral side of the step. The stepped scroll compressor performs compression (three-dimensional compression) not only in the circumferential direction of the wall, but also in the height direction, and therefore can achieve a larger displacement and a larger compressor capacity in comparison with a common scroll compressor (two-dimensional compression) that does not include the step.

CITATION LIST

Patent Document

Patent Document 1: JP 2015-55173 A

SUMMARY OF INVENTION

Problem to be Solved by the Invention

In the stepped scroll compressor, however, fluid leakage at the step is disadvantageously large. In addition, stress is concentrated at the root portion of the step, and the strength is disadvantageously reduced.

In view of this, the inventor et al. have considered regarding a configuration provided with a continuous inclined portion in place of the step provided in the wall and the end plate.

However, the way of setting the tip clearance between the tooth crest of the wall and the tooth base of the end plate to achieve a desired performance in the case where the inclined portion is provided has not been considered.

In view of the foregoing, an object of the present invention is to provide a scroll fluid machine which can achieve desired performance by appropriately setting a tip clearance between a tooth base of an end plate and a tooth crest of a wall including an inclined portion.

Solution to Problem

A scroll compressor according to an embodiment of the present invention employs the following means to solve the problems described above.

A scroll fluid machine according to an aspect of the present invention includes: a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape. An inclined portion in which a distance between opposing surfaces of the first end plate and the second end plate facing each other gradually decreases from an outer peripheral side toward an inner peripheral side of the first wall and the second wall is provided. A tip clearance between a tooth crest of the wall and a tooth base of the end plate facing the tooth crest at normal temperature is greater on the inner peripheral side than on the outer peripheral side.

Since an inclined portion in which the distance between opposing surfaces of the first end plate and the second end plate facing each other gradually decreases from the outer peripheral side toward the inner peripheral side of the wall is provided, the fluid sucked from the outer peripheral side is compressed not only by reduction of a compression chamber corresponding to the spiral shape of the wall, but also by reduction of the distance between the opposing surfaces of the end plates as the fluid moves toward the inner peripheral side.

On the inner peripheral side of the scroll member, fluid is compressed and temperature rise resulting from the compression heat is large in comparison with the outer peripheral side of the scroll member. In addition, since heat is less dissipated on the inner peripheral side than on the outer peripheral side, the temperature is high on the inner peripheral side. Accordingly, during operation, thermal expansion on the inner peripheral side is greater than on the outer peripheral side, and the tip clearance between the tooth crest and the tooth base is small. In view of this, the tip clearance is set such that the tip clearance at normal temperature is larger on the inner peripheral side than on the outer peripheral side. With this configuration, even when heat expansion occurs during operation of the scroll fluid machine, a desired tip clearance can be set from the inner peripheral side to the inner peripheral side, and fluid leakage can be reduced as much as possible while avoiding interference between the tooth crest and the tooth base.

It is to be noted that the tip clearance may be gradually varied, or may be varied stepwise by connecting together a plurality of line segments having different inclinations.

In the scroll fluid machine according to an aspect of the present invention, a tip seal is provided in groove portions formed in the tooth crests of the first wall and the second wall, the tip seal being configured to make contact with the tooth base facing the tip seal to perform sealing against fluid, and a groove depth of the groove portions is greater on the inner peripheral side than on the outer peripheral side.

The groove portion for providing the tip seal is formed in the tooth crest. Also in the tip seal, temperature rise is higher on the inner peripheral side than on the outer peripheral side. Accordingly, the distance (tip seal rear gap) between the bottom surface of the tip seal and the bottom surface of the groove portion becomes smaller on the inner peripheral side than on the outer peripheral side with thermal expansion. When the tip seal rear gap is closed and the bottom surface of the tip seal and the bottom surface of the groove portion make contact with each other, the tip seal protrudes to the opposing tooth base side more than necessary, and the performance of the scroll fluid machine might be reduced. In view of this, by setting the groove depth of the groove portion such that the groove depth is greater on the inner peripheral side than on the outer peripheral side, the tip seal rear gap required according to the thermal expansion is secured. With this configuration, it is possible to avoid a situation in which the inner peripheral side of the tip seal makes contact with the bottom surface of the tip seal groove at an excessive pressure due to thermal expansion, and it is thus possible to suppress reduction of the performance of the scroll compressor.

It is to be noted that the groove depth of the groove portion may be gradually varied, or may be varied stepwise by connecting together a plurality of line segments having different inclinations.

In the scroll fluid machine according to an aspect of the present invention further includes: a wall flat portion whose height does not vary, the wall flat portion being provided in an outermost peripheral portion and/or an innermost peripheral portion of the first wall and the second wall; and an end plate flat portion provided in the first end plate and the second end plate, the end plate flat portion corresponding to the wall flat portion. A flat portion tip clearance between the wall flat portion and the end plate flat portion is constant in a spiral direction.

In the case where the tooth crest of the wall and/or the tooth base of the end plate are inclined, it is difficult to set the measurement point and it is therefore difficult to achieve high measurement accuracy. In view of this, to perform shape measurement with high accuracy, the flat portion is provided at the outermost peripheral portion and/or the innermost peripheral portion of the wall and the end plate, and the tip clearance at the flat portion is set to a constant value. With this configuration, the dimension of the scroll shape and the tip clearance can be readily controlled.

It is to be noted that, in the case where the flat portion is provided in the outermost peripheral portion and the innermost peripheral portion, it is preferable to set the flat portion tip clearance in consideration of thermal expansion such that the flat portion tip clearance is larger on the innermost peripheral side than on the outermost peripheral side.

Advantageous Effect of Invention

By setting the tip clearance such that the tip clearance at normal temperature is larger on the inner peripheral side than on the outer peripheral side, fluid leakage can be reduced as much as possible while avoiding interference between the tooth crest and the tooth base, and thus desired performance of the scroll fluid machine can be achieved even when heat expansion occurs during operation of the scroll fluid machine.

BRIEF DESCRIPTION OF DRAWINGS

FIG. 1A is a longitudinal sectional view, and FIG. 1B is a plan view as viewed from the wall side of the fixed scroll.

FIG. 7A is a side view illustrating a state where the tip seal gap is relatively small, and FIG. 7B is a side view illustrating a state where the tip seal gap is relatively large.

FIG. 11A is a longitudinal sectional view illustrating a combination with a scroll provided with no step, and FIG. 11B is a longitudinal sectional view illustrating a combination with a stepped scroll.

DESCRIPTION OF EMBODIMENTS

First Embodiment

The first embodiment of the present invention will be described below with reference to the drawings.

FIG. 1 illustrates a fixed scroll (first scroll member) 3 and an orbiting scroll (second scroll member) 5 of a scroll compressor (scroll fluid machine) 1. The scroll compressor 1 is used as a compressor that compresses gas refrigerant (fluid) for performing refrigeration cycle of an air conditioner or the like, for example.

The fixed scroll 3 and the orbiting scroll 5 are compression mechanisms made of metal such as aluminum alloy and iron, and are housed in a housing not illustrated. The fixed scroll 3 and the orbiting scroll 5 suck, from the outer peripheral side, fluid guided into the housing, and discharge compressed fluid from a discharge port 3*c* located at the center of the fixed scroll 3.

Figure 1A:
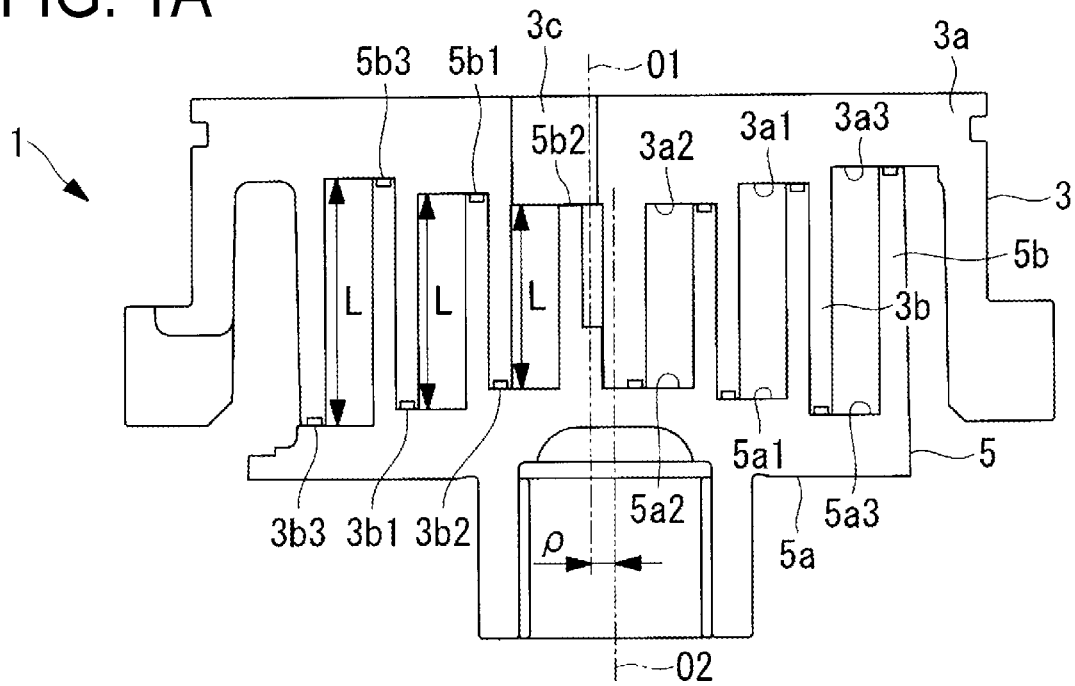
FIGS. 1A and 1B illustrate a fixed scroll and an orbiting scroll of a scroll compressor according to an embodiment of the present invention.

The fixed scroll 3 is fixed to the housing, and includes a substantially disk-plate-shaped end plate (first end plate) 3*a*, and a spiral-shaped wall (first wall) 3*b* disposed upright on one side surface of the end plate 3*a* as illustrated in FIG. 1A. The orbiting scroll 5 includes a substantially disk-plate-shaped end plate (second end plate) 5*a*, and a spiral-shaped wall (second wall) 5*b* disposed upright on one side surface of the end plate 5*a*. The spiral shapes of the walls 3*b* and 5*b* are defined by involute, Archimedean spiral or the like, for example.

The fixed scroll 3 and the orbiting scroll 5 are engaged with each other such that the centers thereof are separated from each other by an orbit radius p and that the phases of the walls 3*b* and 5*b* are shifted by 180°, and fixed scroll 3 and the orbiting scroll 5 are mounted such that a slight clearance (tip clearance) in the height direction is provided between the tooth crest and the tooth base of the walls 3*b* and 5*b* of the scrolls at normal temperature. With this configuration, multiple pairs of compression chambers that are defined by the surrounding end plates 3*a* and 5*a* and the walls 3*b* and 5*b* and are symmetric about the scroll center are formed between the scrolls 3 and 5. With a rotation prevention mechanism such as an Oldham ring not illustrated, the orbiting scroll 5 rotates in orbital motion around the fixed scroll 3.

As illustrated in FIG. 1A, an inclined portion, in which a distance L between opposing surfaces of the end plates 3*a* and 5*a* facing each other gradually decreases from the outer peripheral side toward the inner peripheral side of the spiral-shaped walls 3*b* and 5*b*, is provided.

Figure 2:
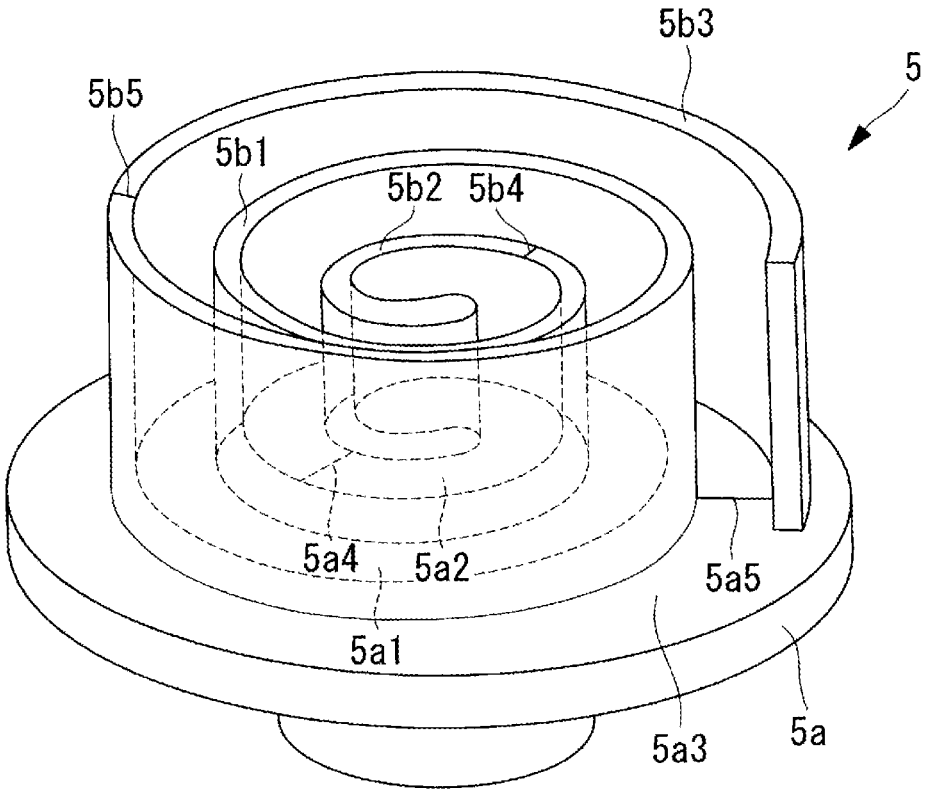
FIG. 2 is a perspective view illustrating the orbiting scroll illustrated in FIG. 1.

As illustrated in FIG. 2, the wall 5*b* of the orbiting scroll 5 is provided with a wall inclined portion 5*b*1 whose height gradually decreases from the outer peripheral side toward the inner peripheral side. An end plate inclined portion 3*a*1 (see FIG. 1A) that is inclined in accordance with the inclination of the wall inclined portion 5*b*1 is provided in the tooth base surface of the fixed scroll 3 that faces the tooth crest of the wall inclined portion 5*b*1. With the wall inclined portion 5*b*1 and the end plate inclined portion 3*a*1, a continuous inclined portion is defined. Likewise, the wall 3*b* of the fixed scroll 3 is provided with a wall inclined portion 3*b*1 whose height is gradually inclined from the outer peripheral side toward the inner peripheral side, and an end plate inclined portion 5*a*1 that faces the tooth crest of the wall inclined portion 3*b*1 is provided in the end plate 5*a* of the orbiting scroll 5.

It is to be noted that the term "gradually" in the inclined portion in the present embodiment is not limited to a smooth inclination, and may include a form that is visually recognized as being gradually inclined as viewed in the entire inclined portion in which small steps inevitably resulting from working processes are connected together stepwise. It should be noted that large steps such as a so-called stepped scroll is not included.

A coating is provided on the wall inclined portions 3*b*1 and 5*b*1 and/or the end plate inclined portions 3*a*1 and 5*a*1. Examples of the coating include manganese phosphate treatment, nickel phosphor plating, and the like.

As illustrated in FIG. 2, wall flat portions 5*b*2 and 5*b*3, each of which has a constant height, are provided on the innermost peripheral side and the outermost peripheral side, respectively, of the wall 5*b* of the orbiting scroll 5. The wall flat portions 5*b*2 and 5*b*3 are provided in a region of 180° around center O2 of the orbiting scroll 5 (see FIG. 1A). Wall inclined connecting portions 5*b*4 and 5*b*5, which serve as bent portions, are provided at portions connecting between the wall inclined portion 5*b*1 and the wall flat portions 5*b*2 and 5*b*3, respectively.

Likewise, the tooth base of the end plate 5*a* of the orbiting scroll 5 is provided with end plate flat portions 5*a*2 and 5*a*3, each of which has a constant height. Likewise, the end plate flat portions 5*a*2 and 5*a*3 are provided in a region of 180° around the center of the orbiting scroll 5. End plate inclined connecting portions 5*a*4 and 5*a*5, which serve as bent portions, are provided at portions connecting between the end plate inclined portion 5*a*1 and the end plate flat portions 5*a*2 and 5*a*3, respectively.

Figure 3:
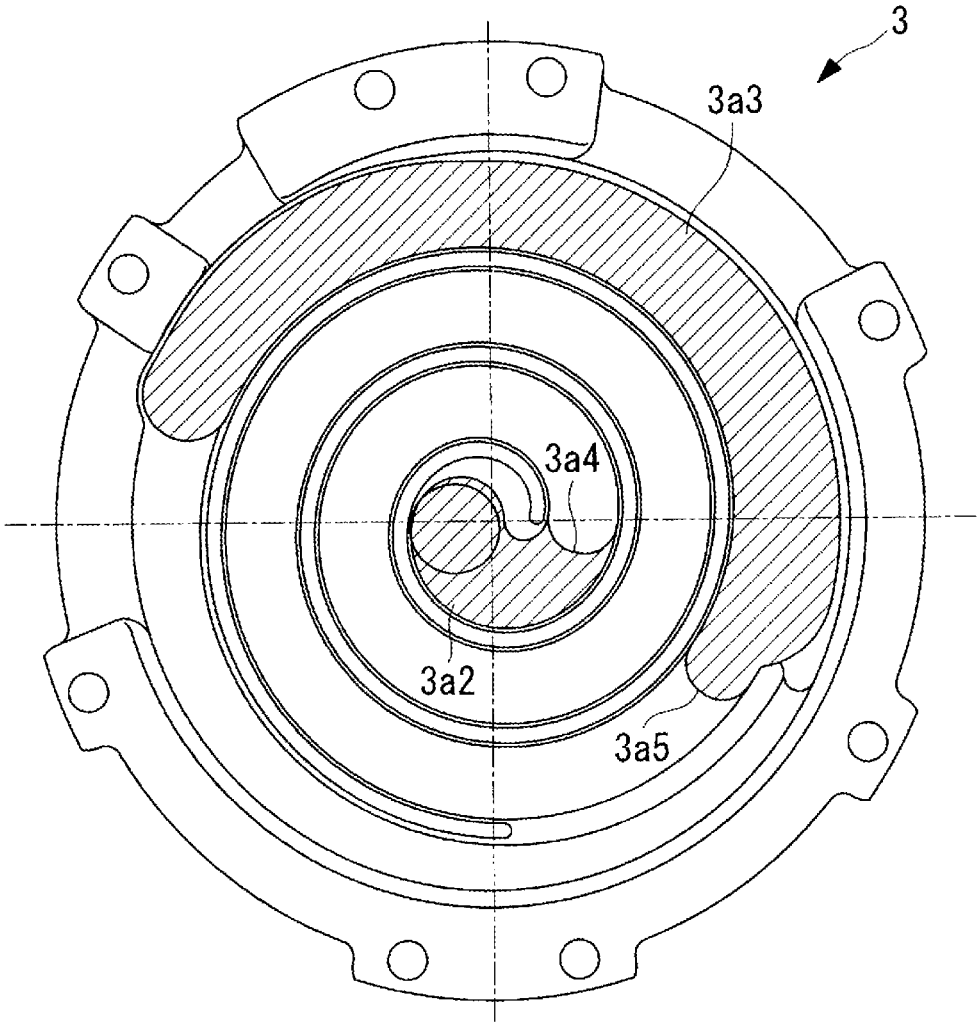
FIG. 3 is a plan view illustrating an end plate flat portion provided in the fixed scroll.
Figure 4:
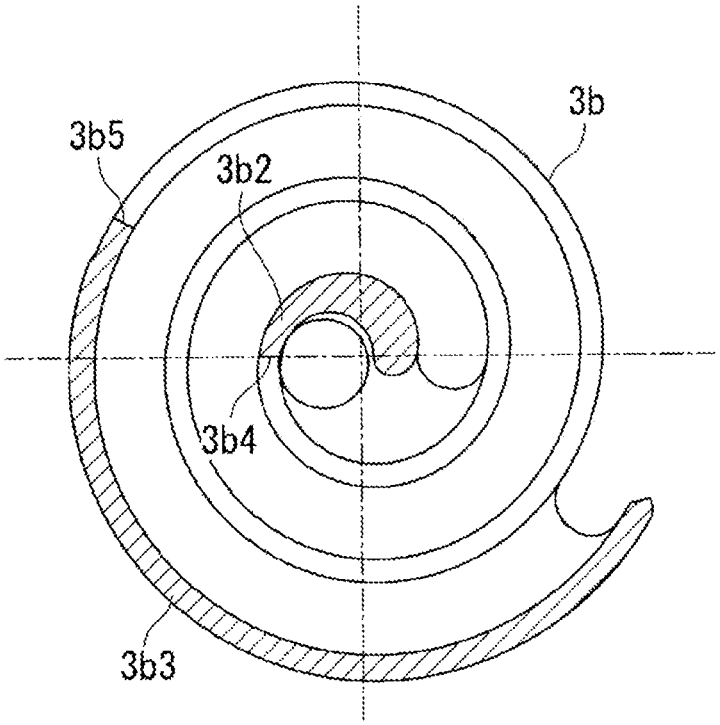
FIG. 4 is a plan view illustrating a wall flat portion provided in the fixed scroll.

As illustrated with hatching in FIG. 3 and FIG. 4, the fixed scroll 3 includes end plate flat portions 3*a*2 and 3*a*3, wall flat portions 3*b*2 and 3*b*3, end plate inclined connecting portions 3*a*4 and 3*a*5 and wall inclined connecting portions 3*b*4 and 3*b*5 as with the orbiting scroll 5.

Figure 5:
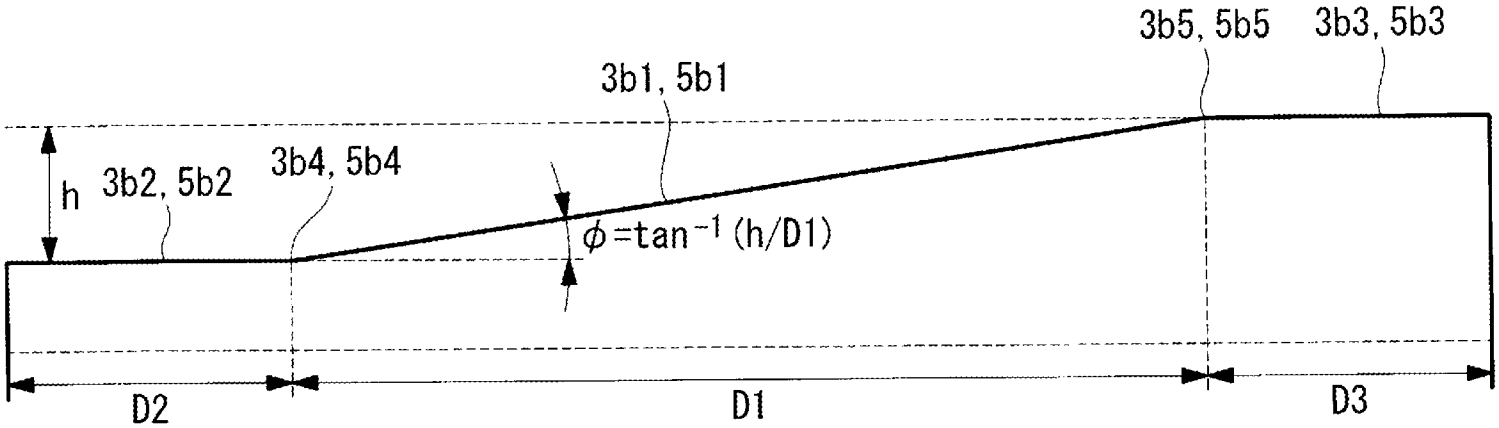
FIG. 5 is a schematic view illustrating a wall unrolled in the spiral direction.

FIG. 5 illustrates the walls 3*b* and 5*b* unrolled in the spiral direction. As illustrated in the drawing, the wall flat portions 3*b*2 and 5*b*2 on the innermost peripheral side are provided over a distance D2, and the wall flat portions 3*b*3 and 5*b*3 on the outermost peripheral side are provided over a distance D3. The distance D2 and the distance D3 correspond to the regions of 180° of the scrolls 3 and 5 around centers O1 and O2. The wall inclined portions 3*b*1 and 5*b*1 are provided over the distance D2 between the wall flat portions 3*b*2 and 5*b*2 on the innermost peripheral side and the wall flat portions 3*b*3 and 5*b*3 on the outermost peripheral side. When a height difference between the wall flat portions 3*b*2 and 5*b*2 on the innermost peripheral side and the wall flat portions 3*b*3 and 5*b*3 on the outermost peripheral side is represented by h, an inclination φ of the wall inclined portions 3*b*1 and 5*b*1 is expressed as follows.

$$\varphi=\tan^{-1}(h/D1) \quad (1)$$

Figure 1B:
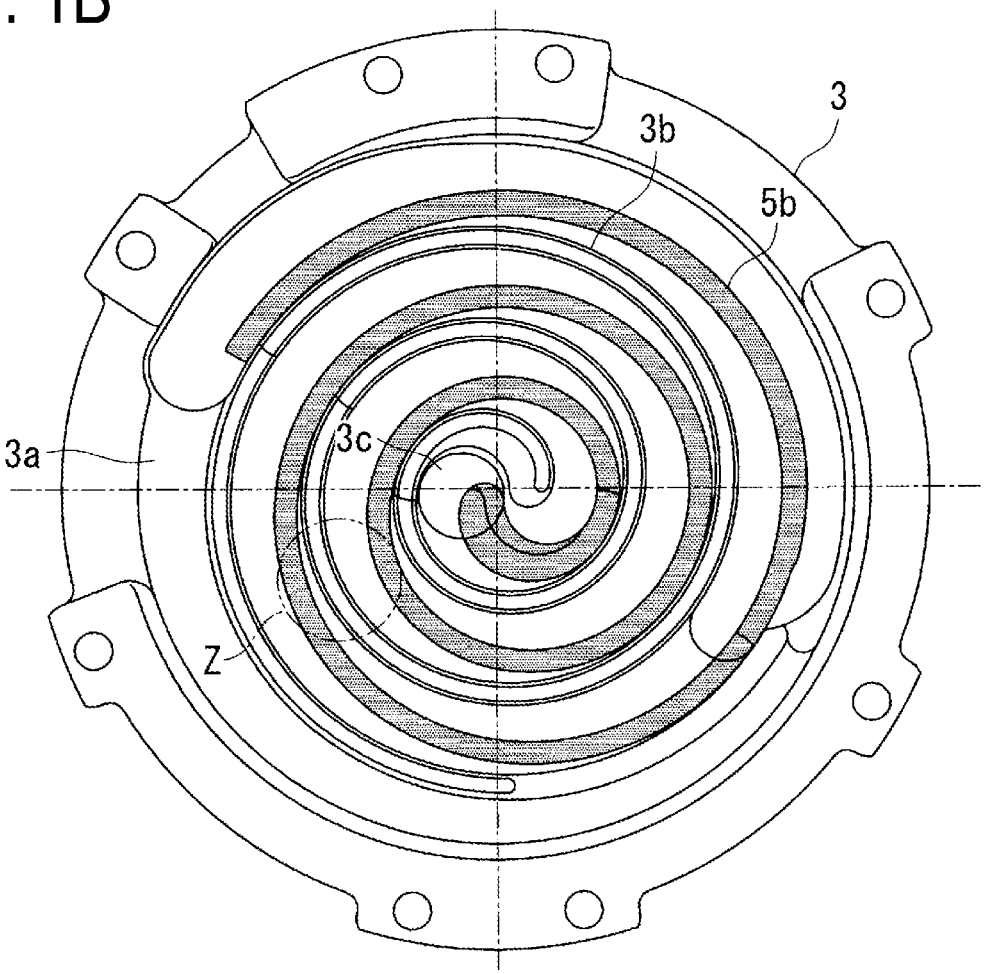
Figure 6:
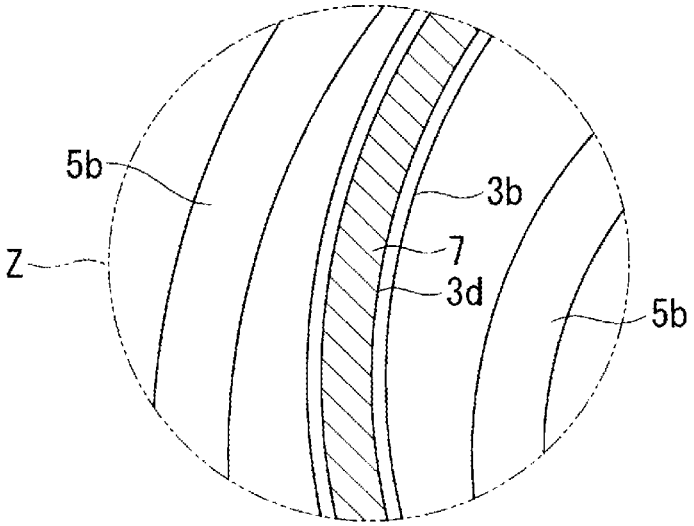
FIG. 6 is a partially enlarged view of the region indicated with reference sign Z in FIG. 1B.

FIG. 6 illustrates an enlarged view of the region indicated by reference sign Z in FIG. 1B. As illustrated in FIG. 6, a tip seal 7 is provided in the tooth crest of the wall 3*b* of the fixed scroll 3. The tip seal 7 is made of resin, and makes contact with the opposing tooth base of the end plate 5*a* of the orbiting scroll 5 to perform sealing against fluid. The tip seal 7 is housed in a tip seal groove 3*d* formed in the tooth crest of the wall 3*b* over the circumferential direction. Compression fluid flown into in the tip seal groove 3*d* pushes the tip seal 7 from the back surface into the tooth base side such that the tip seal 7 makes contact with the opposing tooth base. It is to be noted that the tip seal is provided also in the tooth crest of the wall 5*b* of the orbiting scroll 5.

As illustrated in FIG. 7, a height He of the tip seal 7 in the height direction of the wall 3*b* is constant in the circumferential direction.

Figure 7A:
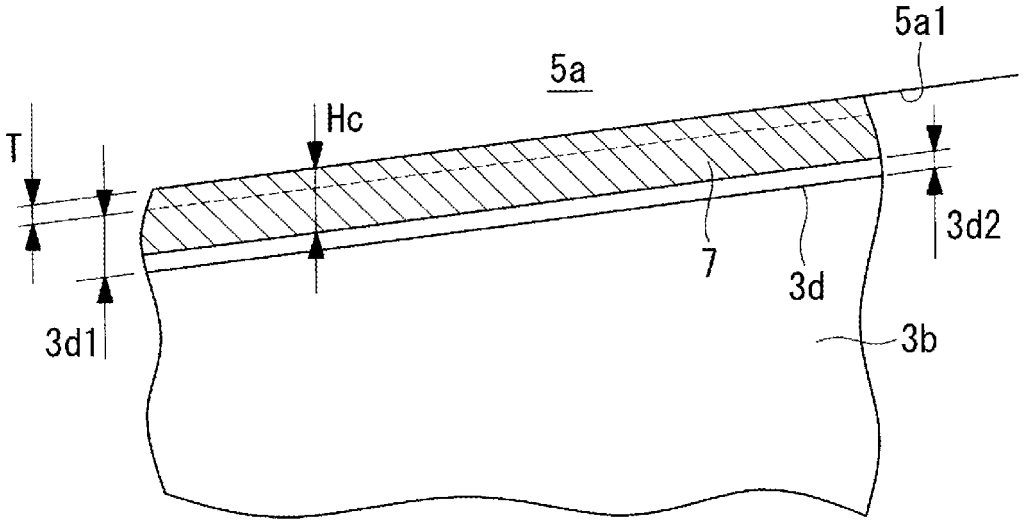
FIGS. 7A and 7B illustrate a tip seal gap of the portion illustrated in FIG. 6.
Figure 7B:
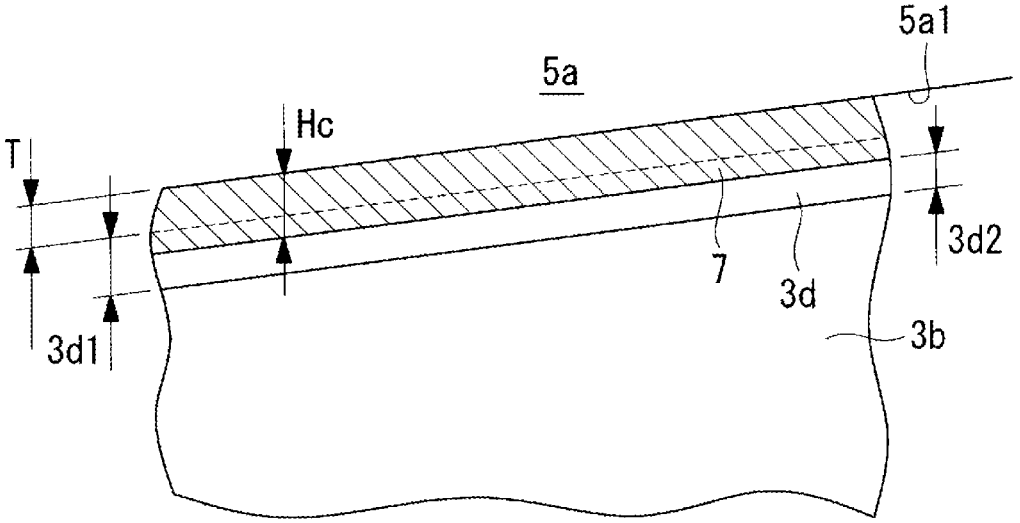

When the scrolls 3 and 5 perform relative rotation in orbital motion, the positions of the tooth crest and the tooth base are relatively shifted by an orbit diameter (the orbit radius ρ×2). In the inclined portion, the tip clearance between the tooth crest and the tooth base varies in response to the positional displacement of the tooth crest and the tooth base. For example, FIG. 7A illustrates a small tip clearance T, and FIG. 7B illustrates a large tip clearance T. Even when the tip clearance T is varied by an orbital motion, the tip seal 7 is pressed by compression fluid from the back surface toward the tooth base of the end plate 5*a*, and thus can follow up and perform sealing.

Figure 8:
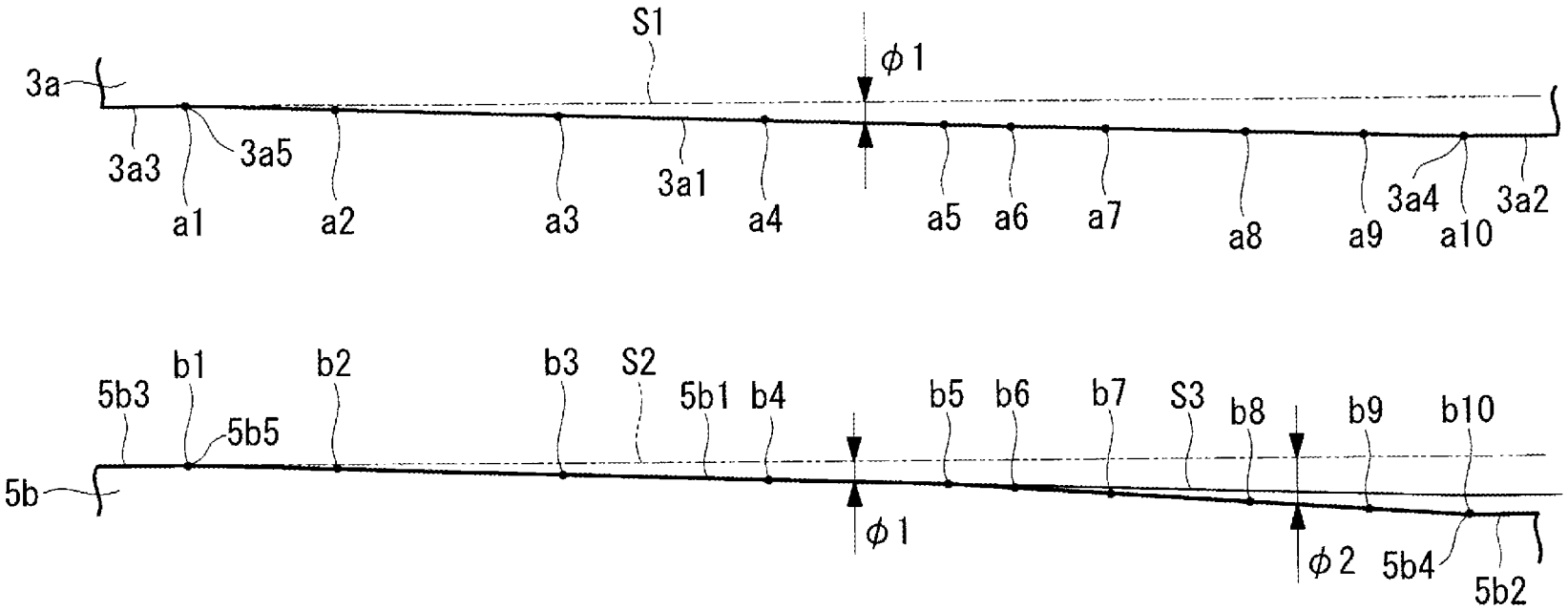
FIG. 8 is a schematic view illustrating a tooth base and a tooth crest of a state unrolled in the spiral direction.
Figure 9:
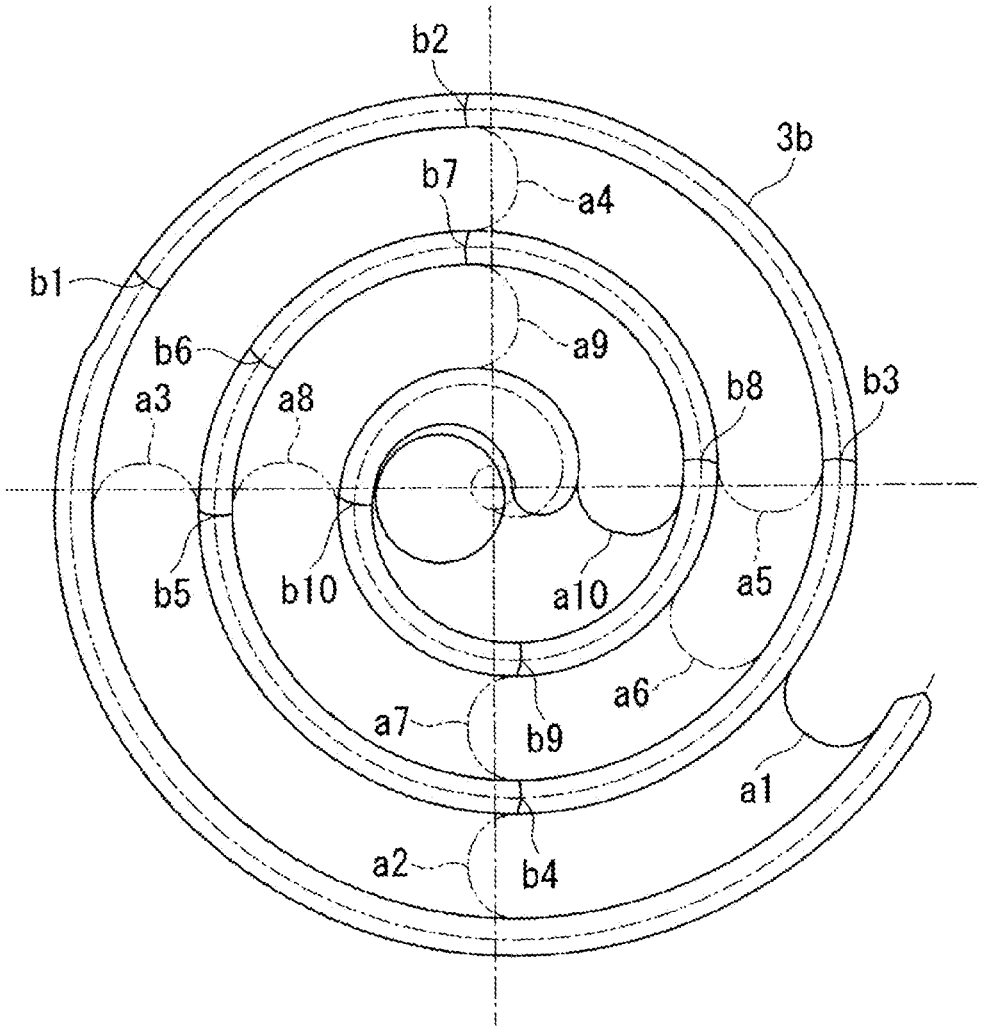
FIG. 9 is a plan view illustrating, on the orbiting scroll, the portions numbered in FIG. 8.

In the present embodiment, as illustrated in FIG. 8 and FIG. 9, the tip clearance is set such that the tip clearance is larger on the inner peripheral side than on the outer peripheral side at normal temperature. Here, the "normal temperature" means an environmental temperature at the time of mounting the scrolls 3 and 5 in the manufacture of the scroll compressor 1, and is 10° C. to 40° C., for example.

FIG. 8 illustrates a state unrolled in the spiral direction as in FIG. 5, and illustrates the tooth base portion of the end plate 3*a* of the fixed scroll 3 on the upper side, and the tooth crest portion of the wall 5*b* of the orbiting scroll 5 on the lower side. Tooth base positions a1 to a10 illustrated in FIG. 8 correspond to positions a1 to a10 illustrated in FIG. 9, and tooth crest positions b1 to b10 illustrated in FIG. 8 correspond to positions b1 to b10 illustrated in FIG. 9, respectively.

FIG. 9 basically illustrates the shape of the orbiting scroll 5, and illustrates, on the tooth base, the positions a1 to a10 of the fixed scroll at the same involute angle positions. It is to be noted that, since the fixed scroll 3 and the orbiting scroll 5 are engaged with each other such that the phases thereof are shifted by 180° around the center, and accordingly, when the fixed scroll 3 and the orbiting scroll 5 are engaged with each other, the positions a1 to a10 correspond to the positions b1 to b10, respectively.

In FIG. 8, the tooth base position a1 of the fixed scroll 3 indicates the end plate inclined connecting portion 3*a*5 on the outer peripheral side, and the position a10 indicates the end plate inclined connecting portion 3*a*4 on the inner peripheral side. Accordingly, the portion on the outer peripheral side (left side) of the position a1 is the wall flat portion 3*a*3 on the outer peripheral side, the portion on the inner peripheral side (right side) of the position a10 is the wall flat portion 3*a*2, and the portion between the position a1 and the position a10 is the end plate inclined portion 3*a*1. The inclination φ1 of the end plate inclined portion 3*a*1 is constant.

It is to be noted that a line S1 indicates a line of a case where the end plate flat portion 3*a*3 on the outer peripheral side has a constant height.

The tooth crest position b1 of the orbiting scroll 5 indicates the wall inclined connecting portion 5*b*5 on the outer peripheral side, and the position b10 indicates the wall inclined connecting portion 5*b*4 on the inner peripheral side. Accordingly, the portion on the outer peripheral side (left side) of position b1 is the end plate flat portion 5*b*3 of on the outer peripheral side, the portion on the inner peripheral side (right side) of the position b10 is the end plate flat portion 5*b*2, and the portion between the position b1 and the position b10 is the wall inclined portion 5*b*1.

The inclination φ1 of the wall inclined portion 5*b*1 in the region from the position b1 to the position b5 is identical to the inclination φ1 of the end plate inclined portion 3*a*1, and the inclination φ2 of the wall inclined portion 5*b*1 in the region from the position b5 to the position b10 is greater than the inclination φ1.

It is to be noted that a line S2 indicates a line of a case where the wall flat portion 5*b*3 on the outer peripheral side has a constant height. S3 is a line extended by extrapolation from the position b5 toward the inner peripheral side (right side), that is, a line at the inclination φ1.

While the position b5 where the inclination is changed may be appropriately set, the position b5 is set in consideration of the thermal expansion difference between the inner peripheral side and the outer peripheral side during the operation.

By changing the inclination of the wall inclined portion 5*b*1 at the position b5 to increase the inclination of the inner peripheral side of the position b5 in the above-mentioned manner, the tip clearance T (see FIG. 7) at the inclined portion is set such that the tip clearance T is greater on the inner peripheral side than on the outer peripheral side.

On the other hand, the tip clearance T of the flat portion between the end plate flat portions 3*a*2 and 3*a*3 and the wall flat portions 5*b*2 and 5*b*3 is constant in the spiral direction. It should be noted that, since the inclination of the inclined portion is greater on the inner peripheral side as described above, the tip clearance T of the flat portions 3*a*3 and 5*b*3 on the outer peripheral side is set to a value greater than the tip clearance T of the flat portions 3*a*2 and 5*b*2 on the inner peripheral side.

Figure 10:
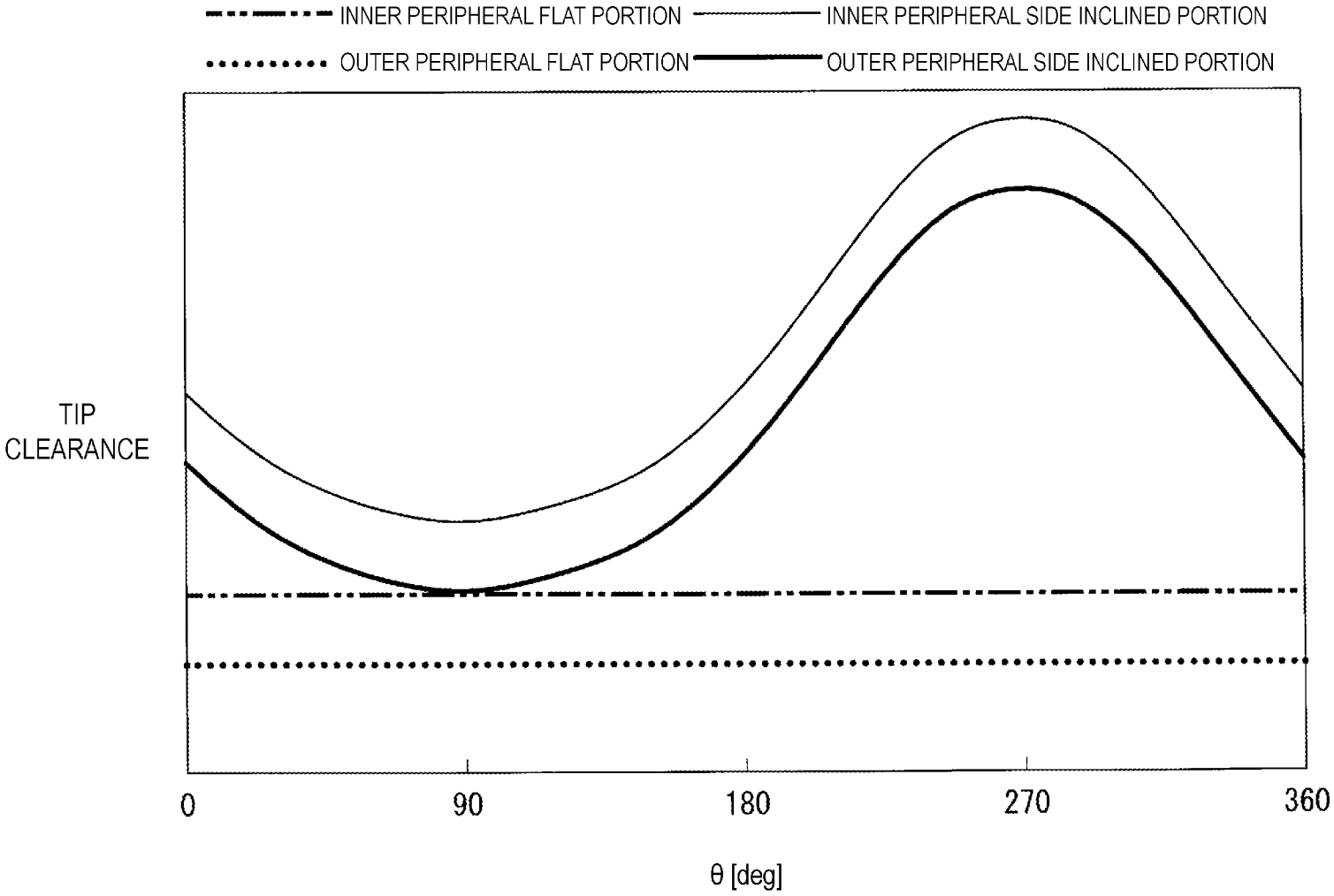
FIG. 10 is a graph showing a tip clearance with respect to an orbit angle.

FIG. 10 illustrates a tip clearance T with respect to an orbit angle θ of the orbiting scroll 5.

As illustrated in the drawing, the tip clearances T in the flat portions 3*a*3 and 5*b*3 on the outer peripheral side and the flat portions 3*a*2 and 5*b*2 on the inner peripheral side are constant regardless of the orbit angle θ, and the tip clearance T of the flat portions 3*a*2 and 5*b*2 on the inner peripheral side is larger than that of the flat portions 3*a*3 and 5*b*3 on the outer peripheral side.

On the other hand, the tip clearance T of the inclined portion on the outer peripheral side at a position slightly on the inclined portion side relative to the positions a1 and b1, and the tip clearance amount of the inclined portion on the inner peripheral side at a position slightly on the inclined portion side relative to positions a10 and b10 vary in a sine curve in accordance with the orbit angle θ. The reason for this is that the inclined portion moves forward or backward in accordance with the orbit angle θ in the inclined portion as described above with reference to FIG. 7. In addition, FIG. 10 shows that the tip clearance T of the inclined portion on the inner peripheral side is greater than the tip clearance of the inclined portion on the outer peripheral side.

The relationship of the tip clearance T between the tooth base of the end plate 3*a* of the fixed scroll 3 and the tooth crest of the wall 5*b* of the orbiting scroll 5 applies also to the relationship between the tooth base of the end plate 5*a* of the orbiting scroll 5 and the tooth crest of the wall 3*b* of the fixed scroll 3.

As with the above-described tip clearance T, a groove depth 3*d*1 (see FIG. 7) of the tip seal groove 3*d* is deeper on the inner peripheral side than on the outer peripheral side. With this configuration, since the height Hc of the tip seal 7 is constant in the spiral direction at normal temperature, a tip seal rear gap 3*d*2 (see FIG. 7) that is the distance between the bottom surface (lower surface) of the tip seal 7 and the bottom surface of the tip seal groove 3*d* is greater on the inner peripheral side.

It is to be noted that a similar groove depth is set to a tip seal groove provided in the tooth crest of the wall 5*b* of the orbiting scroll 5.

The above-described scroll compressor 1 operates in the following manner.

The orbiting scroll 5 is rotated in orbital motion around the fixed scroll 3 by a driving source such as an electric motor not illustrated. In this manner, fluid is sucked from the outer peripheral side of the scrolls 3 and 5, and the fluid is taken into the compression chamber surrounded by the walls 3*b* and 5*b* and the end plates 3*a* and 5*a*. The fluid in compression chamber is compressed as it moves from the outer peripheral side toward the inner peripheral side, and finally compressed fluid is discharged from the discharge port 3*c* formed in the fixed scroll 3. When the fluid is compressed, the fluid is compressed also in the height direction of the walls 3*b* and 5*b* in the inclined portion defined by the end plate inclined portions 3*a*1 and 5*a*1 and the wall inclined portions 3*b*1 and 5*b*1, and thus three-dimensional compression is performed.

According to the present embodiment, the following effects are achieved.

On the inner peripheral side of the scrolls 3 and 5, fluid is compressed and temperature rise resulting from the compression heat is large in comparison with the outer peripheral side of the scrolls 3 and 5. In addition, since heat is less dissipated on the inner peripheral side than on the outer peripheral side, the temperature is high on the inner peripheral side. Accordingly, during operation, thermal expansion is greater on the inner peripheral side than on the outer peripheral side, and the tip clearance T between the tooth crest and the tooth base is small. In view of this, the tip clearance T on the inner peripheral side at normal temperature is set to a value greater than that of the outer peripheral side. With this configuration, even when heat expansion occurs during operation of the scroll compressor 1, a desired tip clearance T can be set from the inner peripheral side to the inner peripheral side, and fluid leakage can be reduced as much as possible while avoiding interference between the tooth crest and the tooth base.

Also in the tip seal 7, temperature rise is greater on the inner peripheral side than on outer peripheral side. Accordingly, the tip seal rear gap 3*d*2 between the bottom surface of the tip seal 7 and the bottom surface of the tip seal groove 3*d* becomes smaller on the inner peripheral side than on outer peripheral side with thermal expansion of the tip seal 7. In particular, in the case where the tip seal 7 made of resin whose linear thermal expansion coefficient is larger than the scrolls 3 and 5 made of metal is used, reduction of the tip seal rear gap 3*d*2 is significant.

When the tip seal rear gap 3*d*2 is closed and the bottom surface of the tip seal 7 and the bottom surface of the groove portion make contact with each other, the tip seal 7 protrudes to the opposing tooth base side more than necessary, and the performance of the scroll compressor 1 might be reduced. In view of this, to secure the tip seal rear gap 3*d*2 required according to the thermal expansion, the groove depth 3*d*1 of the tip seal groove 3*d* is set such that the groove depth 3*d*1 is greater on the inner peripheral side than on the outer peripheral side. With this configuration, it is possible to avoid a situation in which the inner peripheral side of the tip seal 7 makes contact with the bottom surface of the tip seal groove 3*d* at an excessive pressure due to thermal expansion, and it is thus possible to suppress reduction of the performance of the scroll compressor 1.

When the tooth crests of the walls 3*b* and 5*b* and/or the tooth bases of the end plates 3*a* and 5*a* are inclined, it is difficult to set the measurement point and it is therefore difficult to achieve high measurement accuracy. In view of this, to perform shape measurement with high accuracy, the flat portions 3*a*2 3*a*3, 5*b*2 and 5*b*3 are provided at the outermost peripheral portions and the innermost peripheral portions of the walls 3*b* and 5*b* and the end plates 3*a* and 5*a*, and the tip clearance T in the flat portion is set to a constant value. With this configuration, the dimension of the scroll shape and the tip clearance can be readily controlled.

While the inclination of the tooth crest of the wall 5*b* of the orbiting scroll 5 is varied to adjust the tip clearance T in the above-mentioned embodiment as described with reference to FIG. 8, the present invention is not limited to this. Alternatively, the inclination of the tooth base of the end plate 3*a* of the fixed scroll 3 may be varied, or both the tooth crest and the tooth base may be varied. The same may be applied to the relationship between the end plate 5*a* of the orbiting scroll 5 and the wall 3*b* of the fixed scroll 3.

In addition, while the inclination of the tooth crest of the wall 5*b* of the orbiting scroll 5 is varied in two-stage in the above-mentioned embodiment, the inclination of may be varied in three-stage or greater. Alternatively, the tip clearance may be set such that the tip clearance on the inner peripheral side is greater than that of the outer peripheral side by setting different inclinations between the inclination of the inclined portion of the tooth crest and the inclination of the inclined portion of the tooth base facing the tooth crest without providing the variation in the inclined portion.

In addition, while the end plate inclined portions 3*a*1 and 5*a*1 and the wall inclined portions 3*b*1 and 5*b*1 are provided in the scrolls 3 and 5 in the above-mentioned embodiment, the end plate inclined portion and the wall inclined portion may be provided in only one of the scrolls 3 and 5.

Figure 11A:
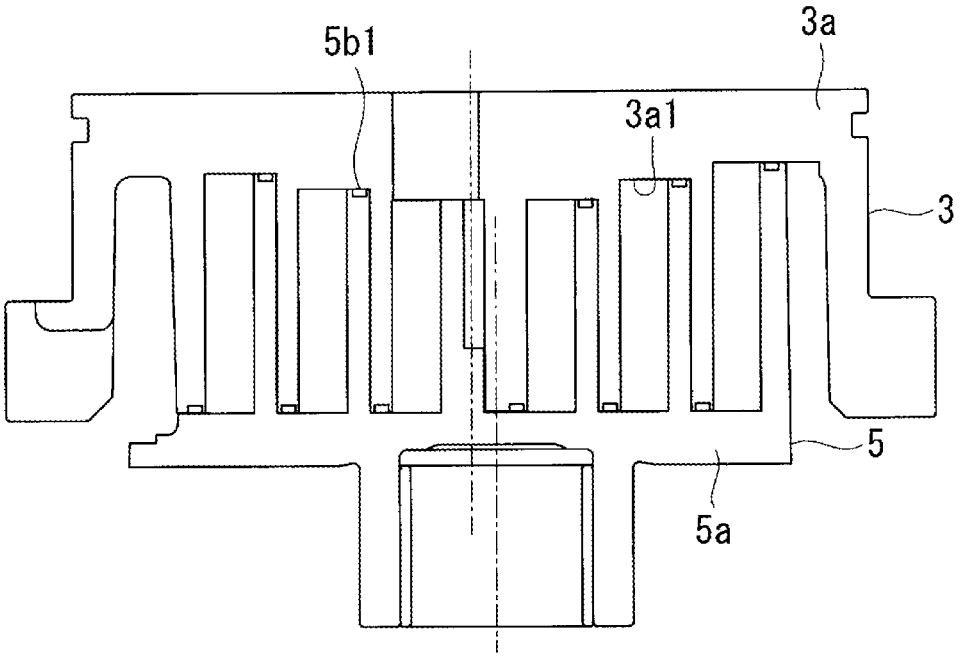
FIGS. 11A and 11B illustrate a modification.

To be more specific, in the case where the wall inclined portion 5*b*1 is provided in the wall of one scroll (the orbiting scroll 5, for example) and the end plate inclined portion 3*a*1 is provided in the end of plate 3*a* of the other scroll as illustrated in FIG. 11A, the wall of the other scroll and the end plate 5*a* of the one scroll may be flat.

Figure 11B:
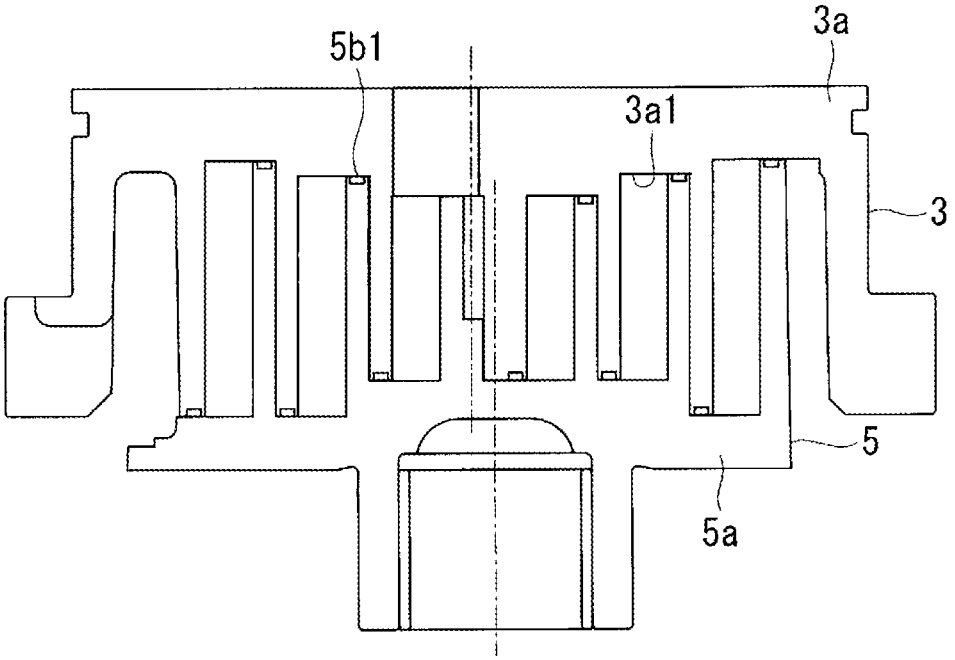

In addition, as illustrated in FIG. 11B, it is possible to adopt a shape combined with a stepped shape of the related art, that is, a shape combined with a shape in which the end plate inclined portion 3*a*1 is provided in the end plate 3*a* of the fixed scroll 3 and a step is provided in the end plate 5*a* of the orbiting scroll 5.

While the wall flat portions 3*b*2 3*b*3, 5*b*2 and 5*b*3 and the end plate flat portions 3*a*2 3*a*3, 5*a*2 and 5*a*3 are provided in the above-mentioned embodiment, the flat portion of the inner peripheral side and/or the outer peripheral side may be omitted so as to extend the inclined portion in the entirety of the walls 3*b* and 5*b*.

While a scroll compressor is described in the above-mentioned embodiment, the present invention is applicable to a scroll expander used as an expander.

REFERENCE SIGNS LIST

1 Scroll Compressor (Scroll Fluid Machine)
3 Fixed Scroll (First Scroll Member)
3*a* End Plate (First End Plate)
3*a*1 End Plate Inclined Portion
3*a*2 End Plate Flat Portion (Inner Peripheral Side)
3*a*3 End Plate Flat Portion (Outer Peripheral Side)
3*a*4 End Plate Inclined Connecting Portion (Inner Peripheral Side)
3*a*5 End Plate Inclined Connecting Portion (Outer Peripheral Side)
3*b* Wall (First Wall)
3*b*1 Wall Inclined Portion
3*b*2 Wall Flat Portion (Inner Peripheral Side)
3*b*3 Wall Flat Portion (Outer Peripheral Side)
3*b*4 Wall Inclined Connecting Portion (Inner Peripheral Side)
3*b*5 Wall Inclined Connecting Portion (Outer Peripheral Side)
3*c* Discharge port
3*d* Tip Seal Groove
3*d*1 Groove Depth
3*d*2 Tip Seal Rear Gap
5 Orbiting Scroll (Second Scroll Member)
5*a* End Plate (Second End Plate)
5*a*1 End Plate Inclined Portion
5*a*2 End Plate Flat Portion (Inner Peripheral Side)
5*a*3 End Plate Flat Portion (Outer Peripheral Side)
5*b* Wall (Second Wall)
5*b*1 Wall Inclined Portion
5*b*2 Wall Flat Portion (Inner Peripheral Side)
5*b*3 Wall Flat Portion (Outer Peripheral Side)
5*b*4 Wall Inclined Connecting Portion (Inner Peripheral Side)
5*b*5 Wall Inclined Connecting Portion (Outer Peripheral Side)
7 Tip Seal
Hc Height of Tip Seal
L Distance between Opposing Surfaces
T Tip Clearance
φ, φ1, φ2 Inclination

The invention claimed is:

1. A scroll fluid machine comprising:

a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape, wherein an inclined portion in which a distance between opposing surfaces of the first end plate and the second end plate facing each other gradually decreases, along a spiral direction, from an outer peripheral side toward an inner peripheral side of the first wall and the second wall is provided, the inclined portion includes a wall inclined portion provided on both of the first wall and the second wall, and an end plate inclined portion provided on both of the first end plate and the second end plate, the scroll fluid machine further comprises:

a wall flat portion that is connected to the wall inclined portion and whose height does not vary, the wall flat portion being provided in an outermost peripheral portion and an innermost peripheral portion of both of the first wall and the second wall; and an end plate flat portion that is connected to the end plate inclined portion and is provided on both of the first end plate and the second end plate, the end plate flat portion corresponding to the wall flat portion, in the inclined portion, a tip clearance between a tooth crest of the walls and a tooth base of the end plates facing the tooth crest is greater on the inner peripheral side than on the outer peripheral side in the spiral direction at normal temperature, a flat portion tip clearance between the wall flat portion of the first wall and the end plate flat portion of the second end plate is constant in the spiral direction of the first wall, and a flat portion tip clearance between the wall flat portion of the second wall and the end plate flat portion of the first end plate is constant in the spiral direction of the second wall.

2. The scroll fluid machine according to claim 1, wherein a tip seal is provided in groove portions formed in the tooth crests of the first wall and the second wall, the tip seal being configured to make contact with a tooth base facing the tip seal to perform sealing against fluid, and a groove depth of the groove portions is greater on the inner peripheral side than on the outer peripheral side in the spiral direction.

* * * * *